US005309994A

United States Patent [19]

Douglas et al.

[11] Patent Number: 5,309,994

[45] Date of Patent: May 10, 1994

[54] METHOD AND APPARATUS FOR INSTALLING A WELL

[75] Inventors: Donald H. Douglas, Clinton; Stafford S. Cooper; Philip G. Malone, both of Vicksburg, all of Miss.

[73] Assignee: U.S. Army Corps of Engineers as represented by the Secretary of the Army, Washington, D.C.

[21] Appl. No.: 77,583

[22] Filed: Jun. 17, 1993

[51] Int. Cl.[5] ..... E21B 43/04

[52] U.S. Cl. ..... 166/278; 166/51; 166/228

[58] Field of Search ..... 166/278, 276, 51, 227, 166/228

[56] References Cited

U.S. PATENT DOCUMENTS

| | | | |
|---|---|---|---|
| 3,216,497 | 11/1965 | Howard et al. | 166/51 X |
| 3,455,387 | 7/1969 | Peters | 166/51 X |
| 3,548,935 | 12/1970 | Harkins | 166/51 |
| 4,936,386 | 6/1990 | Colangelo | 166/278 X |
| 5,078,212 | 1/1992 | Boyle et al. | 166/278 |
| 5,115,864 | 5/1992 | Gaidry et al. | 166/278 |
| 5,183,110 | 2/1993 | Logan et al. | 166/278 |

*Primary Examiner*—Stephen J. Novosad

*Attorney, Agent, or Firm*—Luther A. Marsh

[57] ABSTRACT

A well installation preform for locating and dispensing granular materials into a bore hole around the screen of a well casing is disclosed. A cylindrical sleeve containing a liner is assembled about the screen end of the well casing. The space between the sleeve and the well casing is filled with an ordered layer of granular material including a filter material adjacent the screen, a sealing material above the filter material and the screen and a quantity of filler material above the sealing material. The lower end of the sleeve is blocked while the preform is lowered into the well. The sleeve is thereafter removed whereby the liner is everted and the granular material is uniformly dispensed about the well casing in the bore hole. The sealing material forms a seal above the filter material for establishing an isolated filtration zone about the screen. A method of constructing the well using the preform and the resulting well structure is also disclosed.

11 Claims, 2 Drawing Sheets

METHOD AND APPARATUS FOR INSTALLING A WELL

STATEMENT OF GOVERNMENT INTEREST

The invention described and claimed herein may be manufactured and used by or for the Government of The United States of America for governmental purposes without the payment of royalties thereon or therefor.

BACKGROUND OF THE INVENTION

The invention relates to a method and apparatus for facilitating the installation of a well. In particular, the invention is directed to the installation of a ground water monitoring well wherein the well casing and screen, the filter material and the sealing and back-fill materials are assembled in a clean area and thereafter placed as a preform in the boring.

In a conventional ground water monitoring well installation, a hole is bored in the ground and a clean casing, with the lower portion slotted or perforated to form a screen, is lowered into the bore hole. Granular filler material is poured into the annular space between the inside of the boring and the outside of the well casing. Enough filler material is added to cover all of the slotted screen portion of the wall casing. A clay barrier of low permeability is installed above the filter material by dropping pelletized clay (typically bentonite) into the annular space. If the bore hole is dry, water is poured therein to hydrate the pelletized clay in order to form a cap or seal above the filter material. Clean back-fill material (for example, soil from the bore hole) is used to fill the annular space to the ground level. The well is then surged and pumped to develop the filter material and wash out any fine soil particles that have mixed with the filter material.

Conventional techniques for installing ground water monitoring wells produce a number of problems and uncertainties in the final configuration. The bore hole may slough or cave pushing soil against the screen to thereby cause clogging. The filter material added from the top of the bore hole may bridge across the annular space and create voids opposite the screen slots so that the filter material is not properly located and the adjacent soil may clog the screen slots. The bentonite pellets may also bridge over the annular space and thus may not form a capping layer atop and adjacent the filter material. When the pellets do not form a continuous layer atop the filter material, fluids from the surface can be drawn down the annular space and through the filter material into the slots in the well screen. Thus, when the clay seal does not form properly, the well no longer takes fluids only from the soil adjacent to the screen through the filter material, but also receives fluids from above including surface water. In wells used for monitoring water quality, the samples are worthless if contamination caused by infiltration of surface water is present in the samples. The problem is equally serious when the well is used to obtain soil gas samples where air can be pulled into the infiltration zone and thereby dilute the soil gas.

SUMMARY OF THE INVENTION

The present invention is based upon the discovery that a preform may be constructed for installation at the bottom of a bore hole. The preform supports dry granular material in ordered layers around the casing which are dispensed in the bore hole adjacent the screen. The preform is constructed of a fabric-lined tube with one end held against a capped end of the casing adjacent the screen and extending along the well casing away from the cap. One end of the liner is attached to the cylindrical member adjacent the cap and removal of the cylindrical member causes the liner to evert whereby the granular material is uniformly dispensed in ordered layers adjacent the well casing in the bore hole. As a result, a filtration zone is formed which is isolated from unpercolated fluids above the well screen which may contaminate the well.

In a particular embodiment, the invention comprises a well installation preform for locating and dispensing granular materials into a bore hole around the screen of a well casing inlet comprising a cylindrical member adapted to be removably located over the screen for insertion into the bore hole with the casing; a cap element within the cylindrical member having one end arranged for attachment to the inlet end of the casing adjacent the screen; a flexible sleeve element is arranged along an inner wall of the cylindrical member. The sleeve element has one end wrapped around the end of the cylindrical member adjacent the cap and is attached to an outer surface of the cylindrical member. The other end of the sleeve is secured for relative movement with respect to the cylindrical member to define an annular space between the well casing and the cylindrical member to contain the granular material therein. The granular material is disposed in a multi-layered ordered arrangement comprising a layer of filter material extending from the cap for bridging the filter, a layer of sealing material adjacent the filter material and a layer of filler material adjacent the sealing material. Means is provided for extracting the cylindrical member and everting the liner such that the granular material is uniformly dispensed from the annular space in the preform to between the casing and the bore hole. The granular material is maintained in multi-layered arrangement by the everting action of said liner. The layered arrangement establishes a filtration zone in the bore hole about the screen which is isolated by the sealing material.

In accordance with another aspect of the invention, there is provided a method for developing a well with granular material comprising locating a preform adjacent a screen inlet of the well casing which has a cap attached thereto. The preform includes a cylindrical member having a flexible liner arranged therein with one end turned around and secured to the end of the cylindrical member adjacent the cap. The other end of the liner is open and positioned at least beyond the other end of the cylindrical member. The cylindrical member is filled with selected amounts of granular materials in ordered layers comprising filter materials extending from the cap and bridging the screen, a capping or sealing material adjacent the filter material and a filler material above the capping material. The method further includes everting the liner and dispensing the granular materials in the ordered layers corresponding to the arrangement thereof in the preform.

DESCRIPTION OF THE INVENTION

Figure 1:
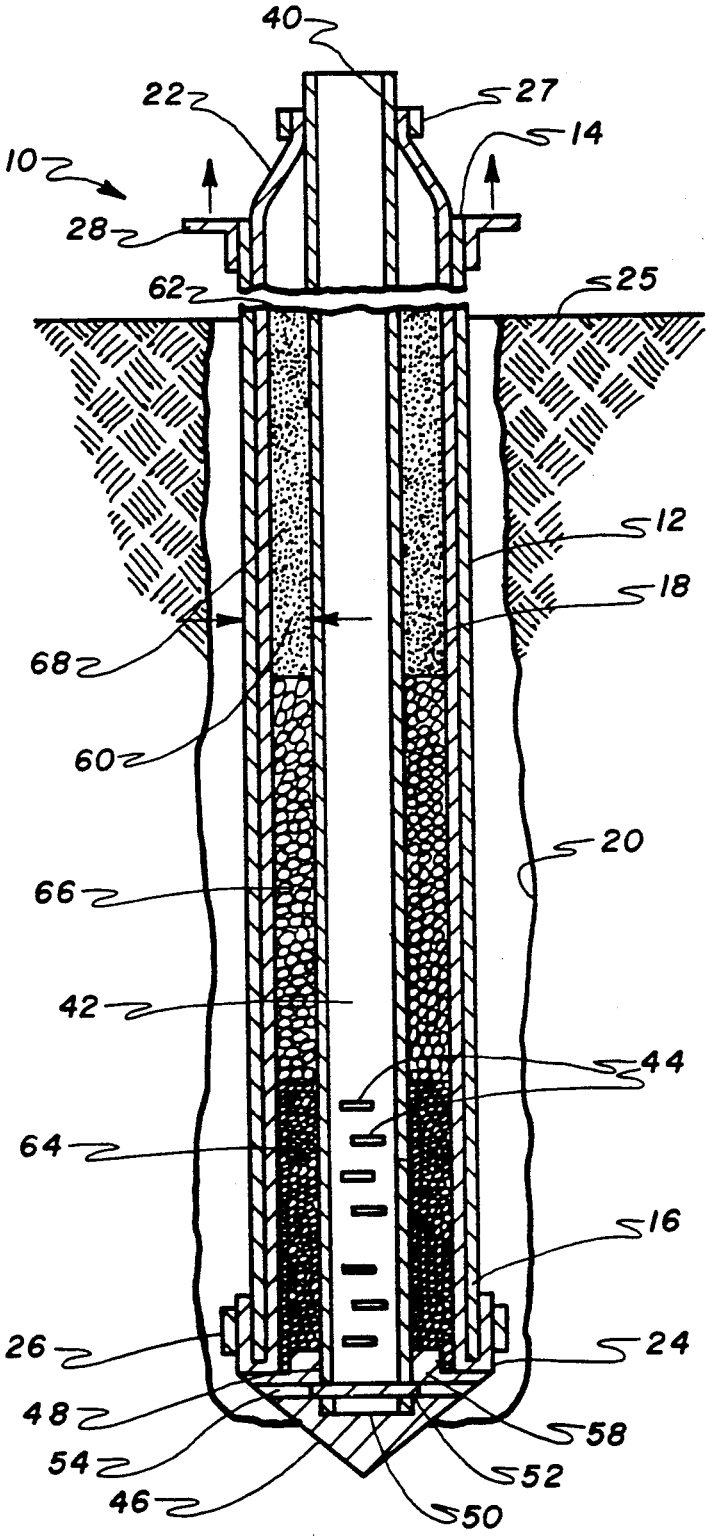
FIG. 1 is a fragmentary side sectional elevation of the well installation preform in accordance with the present invention.

As illustrated in FIG. 1, the present invention comprises a preform 10 adapted for facilitating installation and development of a well, and particularly a ground water monitoring well. The preform 10 includes a cylindrical member or sleeve 12 which is open at the respective top and bottom ends 14 and 16. The sleeve 12 has a flexible liner 18 positioned therewithin along an entire length and extending beyond its ends 14 and 16. The sleeve 12 may be made of metal or rigid or semi-rigid plastic. The flexible liner 18 may be formed of a permeable or nonpermeable cloth, or wire fabric, or a plastic membrane or laminate.

The outer diameter of the sleeve 12 is selected to allow the preform 10 to be lowered into a bore hole 20 of a well without being obstructed by irregularities which may exist in the bore hole walls. For example, a four inch diameter sleeve 12 may be utilized to install a casing with filter, sealing and filling materials in a boring having a six inch diameter. The length of the sleeve 12 is sufficient so as to contain sufficient volumes of various granular materials to be dispensed within the bore hole 20 in order to successfully seal and develop the well.

Figure 2:
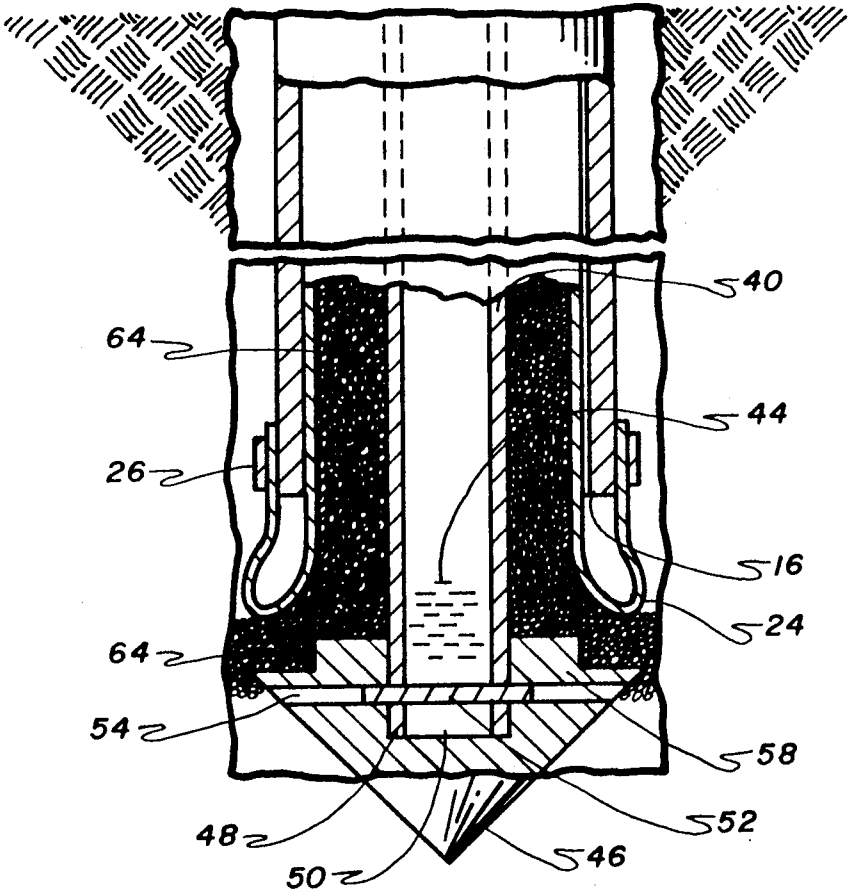
FIG. 2 is an enlarged side sectional view illustrating the cylindrical member and the partially everted liner and partially dispensed granular material in the bore hole adjacent the well casing screen.

The liner 18 is adapted to completely line the interior of the sleeve 12 and to extend at its respective upper and lower ends 22 and 24 beyond the corresponding ends 14 and 16 of the sleeve. The liner 18 has a diameter slightly smaller than the sleeve 12. As shown in FIG. 2, the lower end 24 of the liner 18 may be flared or stretchable so as to be turned over the lower end 16 of the sleeve 12. The turned over lower end 24 of the liner 18 may be glued and clamped to the outside surface of the lower end 16 of the sleeve 12 by a suitable means such as by an elastic band 26 and an adhesive. The upper end 22 of the liner 18 extends above the upper end 14 of the sleeve 12 and may extend to the surface 25 or it may be secured to the casing 40 by an elastic fastener 27.

A lifting flange or collar 28 is positioned about the upper end 22 of the sleeve 12 encircling the same and secured thereto by appropriate fasteners or by welding. Lifting flange 28 may have apertures or other appropriate fasteners, not shown, for attachment to lifting cables, also not shown, when the preform 10 is to be extracted from the bore hole 20.

Typically, when a well is constructed a well casing 40 is lowered in sections into the bore hole 20. The lowermost section 42 of the casing string 40 is formed with apertures or slots 44 which act as a screen for the well. In accordance with the invention, a cap 46 in the form of a conical member is attached to the lower end of the casing 42. In the embodiment illustrated, the cap 46 has a cylindrical recess 50 for receiving the lower end of the casing 42 therein. A pin 52 passing through aperture 54 secures the cap 46 and casing 42 together as illustrated.

The cap 46 is adapted to close the lower end 48 of the casing 42. It is sized and shaped to allow the casing to be lowered into the bore hole 20 without snagging obstructions therein and also to clear minor obstructions. The cap 46 includes an integral annular extension or spacer 58 which is designed to fit within the inner diameter of the sleeve 12 and liner 18 in relationship sufficiently snug so that the preform 10 and casing 40 may be lowered into the bore hole 20 without separating.

At least the lower section 42 of the well string or casing 40 and the corresponding length of the sleeve 12 and liner 18 may be filled with granular materials 62 which are formed in ordered layers of different kinds of materials adapted for different functions. For example, the granular material comprises a first layer of granular filter material 64 which is disposed within the annular space 60 between the sleeve 12 and the casing 42. Filter material 64 extends from the cap 46 filling a portion of the annular space 60 so as to extend beyond the slots 44 in bridging relation. A capping or sealing layer 66 is disposed atop the filter material 64; and backfill material 68 is disposed above the sealing material 66 as illustrated.

The preform 10 may be assembled at a location remote from the bore hole 20 and the entire preform 10 may be lowered into the bore hole 20 as a unit. The sleeve 12 and lower casing 42 acting as a support for the granular material 62 in the annular space 60 there between allows for the careful assembly of the ordered layers of material. When the annular space 60 is filled with appropriate amounts of the granular material 62 the top end 22 of the liner is secured for relative movement with respect to the sleeve 12. In the embodiment illustrated, the upper end 22 of the liner 18 is secured to the well casing string 40 by an elastic 27 or a rope as desired. For a shallow well (e.g. 10–20' in length), the preform may include the entire well casing string.

When fully assembled, the preform 10 is lowered into the bore hole 20 and positioned as illustrated in FIG. 1. In order to construct the well, the granular material 62 must be distributed in a generally uniform manner about the well casing 40 and especially about the lower section 42 above the screen 44. The sealing material 66 must be disposed above the filter material 64 to form an isolated filtration zone 76 about the slots 44.

When the sleeve 12 is withdrawn or separated from the cap 46, the liner 18 acts as a slidable bearing surface between the sleeve 12 and the granular material 62. As illustrated in FIG. 2, the liner 18 is drawn inside out or is everted as the sleeve 12 is extracted from the bore hole 20. At the same time, the granular material 62 spreads out evenly and fills the bore hole 20 as illustrated.

Figure 3:
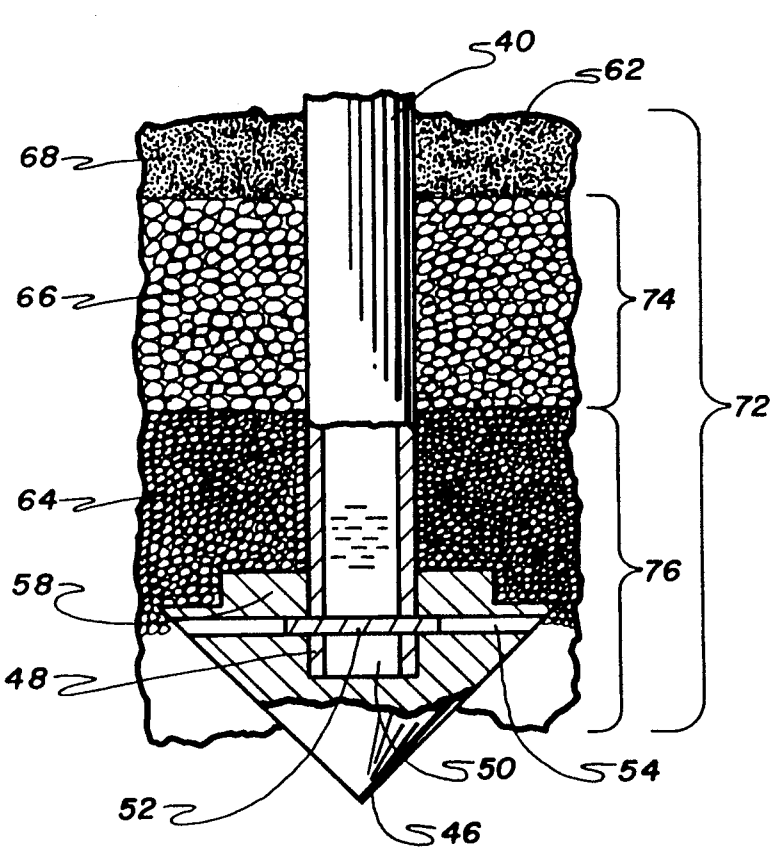
FIG. 3 is a side sectional elevation illustrating the layered dispensed materials in a developed well.

When the sleeve 12 and liner 18 are fully withdrawn from the bore hole 20, the granular material 62 forms a generally uniformly layered structure 72 as illustrated in FIG. 3. The layered structure 72 comprises the distributed granular material 62 with the granular filter material 64 surrounding the slots 44 in the casing 42, the clay sealing material 66 atop the filter material 64 above the slots 44 and the filler material 68 above the sealing material 66. The weight of the column of filler materials as well as added water supplied from the surface causes the dry granular sealing material 66 to form a clay cap or seal 74 above the slots 44. The filter material 64 and the side walls of the bore hole surrounding the slots 44 form a filtration chamber or zone 76 which is isolated and sealed from unpercolated sources of ground water which may infiltrate the bore hole 20 from the clay cap 74. Also, the clay cap 74 renders the filtration zone fairly gastight so that if gas samples are withdrawn from the well, gas infiltration from the surface does not contaminate or dilute the samples.

The filter material 64 may be any one of a variety of suitable materials for the purpose including, for example sized and graded quartz sand. The sealing material 66 may be clay in a powdered, granular, or pelletized form such as bentonite clay or other sealing material. The filler material 68 may be clean sand or soil removed from the bore hole 20 during drilling.

After removal of the sleeve 12, the installation of the well can be completed by adding additional backfill materials and by sealing the opening in the ground surface with cement grout. Any appropriate concrete sealant or protective device or structure can be built around the well casing at the surface.

In order to develop the well, it is pumped or surged with water until any contaminates which may have been trapped in the filtration zone 76 are washed away.

The advantages of the present invention include the isolation of the filtration zone 76 from the soil contaminants above the slots 44. Further, the distribution of materials about the casing 40 is more uniform and the resulting layered structure 72 functions more reliably and predictably than prior arrangements. Further, assembly of a preform in a clean environment allows for the various granular materials to be properly sieved and dried to a uniform moisture level which will allow the materials to flow properly when they are dispensed in the borehole.

It should be understood that the volume of materials 62 layered in the annular space 60 between the cylindrical member 12 and the casing 40 is less than the volume of the space between the bore hole wall 20 and the member 12. Accordingly, the filter material 64 and sealing material 66 must be provided in sufficient amounts to adequately fill the bore hole 20 to bridge the screen 44 and seal the well respectively. Filler material 68 may be adequate to generally fill the remainder of the bore hole 20 and be supplemented with manually dispensed back fill material as necessary.

While there has been described what at present is considered to be the preferred embodiment of the present invention, it will be readily apparent to those skilled in the art that various changes and modifications may be made therein without departing from the invention and it is intended in the appended claims to cover such changes and modifications as fall within the true spirit and scope of the invention.

What is claimed is:

1. A well installation preform for locating and dispensing granular materials into a bore hole around the screen of a well casing comprising:

a cylindrical sleeve member adapted to be removable located about the casing adjacent the screen for insertion into the borehole with the casing;

A closure member for the sleeve having one end arranged to be held secured to the casing adjacent the screen and being separable from the sleeve;

a flexible liner arranged along an inner wall of said sleeve, said liner having one end wrapped around the end of the sleeve adjacent the closure and attached to an outer surface of said sleeve, and its other end secured for relative movement with respect to the sleeve, said sleeve and liner defining an annular space about said casing for containing the granular materials therein, said granular materials disposed in said annular space in a multilayered arrangement comprising a layer of filter material extending from the closure in a sufficient amount to bridge the screen, a layer of capping or sealing material adjacent to the filter material above the screen and a layer of filler material adjacent the capping material; and means for separating the sleeve from the closure and for extracting the cylindrical member from the bore hole and everting the sleeve such that the granular material is uniformly dispensed from the annular space in the preform to between the casing and borehole and is maintained in said multilayered arrangement by the everting action of said liner in accordance with extraction of said sleeve, said layered arrangement for establishing an isolated filtration zone in the borehole about the screen said filtration zone being isolated by said capping material.

2. The preform of claim 1, wherein the liner includes means for securing one end of the liner to a lower end of the sleeve and an opposite end of the liner secured with respect to said lower end for allowing relative motion therebetween.

3. The preform of claim 2, wherein the opposite end of the liner is secured to the well casing.

4. The preform of claim 2, wherein the opposite end of the liner extends to the surface.

5. The preform of claim 1, wherein the closure comprises a conical tip sized for clearing obstructions of the bore hole walls and for engaging the bottom of the bore hole.

6. The preform of claim 1, wherein the closure is secured to the lower end of the casing and further includes an annular spacer member for receiving the sleeve thereabout for establishing an annular space between the casing and the sleeve.

7. The preform of claim 1, wherein the liner is a flexible sleeve selected from the group of materials including a natural or synthetic fabric, a plastic membrane, a laminate, a wire fabric, a permeable material and a nonpermeable material.

8. The preform of claim 1, wherein the well is for ground water monitoring.

9. A well constructed by a well installation preform of claim 1.

10. A method for constructing a well with granular material comprising the steps of:

locating a preform adjacent a closed screen end of a well casing, said preform including a cylindrical sleeve opposite ends and having a flexible liner arranged therein with one end secured to an end of the sleeve adjacent the closed screen end and its other end being open and positioned beyond the other end of the sleeve;

filling the member with granular materials at said open end, wherein said granular materials comprise a layer of a filter material extending from the closure and above the screen in bridging relation, a sealing material above the screen and adjacent the filter material and a filler material above the sealing material; and extracting said sleeve from the bore hole while holding the other end of the liner against movement whereby the liner everts to uniformly dispense the granular material in the bore hole during the eversion of the liner for establishing a filtration zone in the bore hole about the filter isolated by said capping material.

11. A well constructed in accordance with the method of claim 10.

* * * * *